US012767295B2

(12) United States Patent
Gillham et al.

(10) Patent No.: US 12,767,295 B2
(45) Date of Patent: Oct. 20, 2026

(54) FAST LAUNCH AND RECOVERY SYSTEM FOR AUTONOMOUS UNDERWATER VEHICLE

(71) Applicant: Impossible Metals Inc., San Jose, CA (US)

(72) Inventors: Jason Gillham, San Jose, CA (US); Joëlle Rennick, San Jose, CA (US)

(73) Assignee: Impossible Metals Inc., San Jose, CA (US)

( * ) Notice: Subject to any disclaimer, the term of this patent is extended or adjusted under 35 U.S.C. 154(b) by 352 days.

(21) Appl. No.: 18/521,138

(22) Filed: Nov. 28, 2023

(65) Prior Publication Data

US 2024/0174334 A1 May 30, 2024

Related U.S. Application Data

(60) Provisional application No. 63/428,318, filed on Nov. 28, 2022.

(51) Int. Cl.
*B63G 8/00* (2006.01)
*B63B 27/16* (2006.01)

(52) U.S. Cl.
CPC ..... *B63G 8/001* (2013.01); *B63B 27/16* (2013.01); *B63B 2027/165* (2013.01); *B63G 2008/002* (2013.01)

(58) Field of Classification Search
CPC ..... B63B 27/00; B63B 27/04; B63B 27/08; B63B 27/10; B63B 27/12; B63B 27/14; B63B 27/143; B63B 27/16; B63B 2027/165; B63B 27/18; B63B 27/19; B63B 27/28; B63B 27/29; B63B 27/30;
(Continued)

(56) References Cited

U.S. PATENT DOCUMENTS 10,351,212 B2 * 7/2019 Jourdan ..... B63G 8/001
10,583,897 B2 * 3/2020 Hartland ..... G01V 1/3843
11,828,042 B2 * 11/2023 Crowson ..... E02F 3/907
(Continued)

FOREIGN PATENT DOCUMENTS

CN 111959729 A 11/2020
CN 112896472 A 6/2021
(Continued)

OTHER PUBLICATIONS

International Search Report and Written Opinion for International Patent Application No. PCT/US2023/81289, dated May 6, 2024 (16 pages).

*Primary Examiner* — Daniel V Venne
(74) *Attorney, Agent, or Firm* — Foley & Lardner LLP

(57) ABSTRACT

A launch and recovery system is presented, the system includes a launch system with an A-frame crane operable to lower an autonomous underwater vehicle (AUV) from the deck level of a ship to the sea level below the deck level. The system further includes a recovery system configured to collect the AUV from just below or at the sea level, the recovery system includes a weight-bearing lifting crane, one or more stabilizing arms, and a funnel. Additionally, the system includes a recovery pad and trolley system configured to receive the AUV from the recovery system, and a rail system with a network of rails configured to accept a trolley with the AUV from the recovery pad and trolley system.

13 Claims, 7 Drawing Sheets

(58) Field of Classification Search
CPC ..... B63B 27/36; B63G 8/00; B63G 8/001; B63G 8/002
USPC ..... 114/44, 51
See application file for complete search history.

(56) References Cited

U.S. PATENT DOCUMENTS

| | | | | |
|---|---|---|---|---|
| 11,845,521 | B2 * | 12/2023 | Santana Lima | B63B 21/20 |
| 2006/0191457 | A1 | 8/2006 | Murphy | |
| 2021/0291947 | A1 | 9/2021 | Slocum et al. | |
| 2021/0331771 | A1 | 10/2021 | Zhang et al. | |

FOREIGN PATENT DOCUMENTS

| | | | |
|---|---|---|---|
| CN | 115056924 | A | 9/2022 |
| DE | 102012112333 | A1 | 1/2014 |
| EP | 2969734 | B1 | 7/2020 |

* cited by examiner

FAST LAUNCH AND RECOVERY SYSTEM FOR AUTONOMOUS UNDERWATER VEHICLE

CROSS-REFERENCE TO RELATED APPLICATIONS

This application claims the benefit of U.S. Provisional Patent Application No. 63/428,318, titled "FAST LAUNCH AND RECOVERY SYSTEM FOR AUTONOMOUS UNDERWATER VEHICLE," which was filed on Nov. 28, 2022 and is incorporated herein by reference in its entirety.

FIELD OF TECHNOLOGY

The present disclosure relates generally to deep-sea mining systems and more specifically to a launch and recovery (LAR) system for autonomous underwater vehicles (AUV) used in deep-sea mining operations. The LAR system can be deployed on the deck of a mining ship.

BACKGROUND

As the world transitions to green energy solutions, there is a growing demand to store energy in reusable batteries made from critical metals such as nickel, copper, and cobalt. Currently, there are fewer sources of these metals remaining on land and these land-based resources can be in hard to reach places and/or within sensitive ecosystems. Deep sea mining is an un-tapped source of critical metals in the form of ore nodules (e.g., polymetallic ferromanganese nodules) and has been the focus of the mining industry in recent years.

Technical difficulties associated with deep-sea mining include the ocean depths (e.g., 5 km to 6 km) and the extreme pressures (e.g., between 500 bar and 600 bar) at which the mining of the ore nodules occurs, and the techniques required to transport the mined ore up to the ocean surface. There are two systems that have been widely examined and determined feasible on a small scale: (i) seabed dredging collector systems that pump the ore to the surface as a slurry through vertical riser pipes, and (ii) mechanical lifting systems that use synthetic ropes. However, both systems suffer from reliability and scaling issues, and can cause irreparable damage to sensitive environments due to the disturbances caused on the seabed during the mining process.

Therefore, there is a need for more sustainable ways to harvest minerals from the sea floor whilst keeping the seabed ecosystem intact.

BRIEF SUMMARY

A launch and recovery (LAR) system for launching and recovering autonomous underwater vehicles (AUVs) used in deep-sea mining operations and methods for using the same are disclosed herein. According to some embodiments, the disclosed LAR system can autonomously: (i) recover AUVs ascending from the seabed, (ii) remove the load from the recovered AUVs, (iii) recharge the AUVs or direct the AUVs to a service area for repairs, and (iv) return the AUVs back to the water. In some implementations, the LAR system includes a recovery system for lifting the AUVs out of the sea, a recovery pad and trolley system for disposing the recovered AUVs on the deck of the mining ship, a rail system for directing the recovered AUVs on the deck within the LAR system, a launch system for returning the AUVs back to the sea, and a control center for supervising the operations of the LAR system.

BRIEF DESCRIPTION OF THE DRAWINGS

The accompanying figures, which are included as part of the present specification, illustrate the presently preferred embodiments and together with the general description given above and the detailed description of the preferred embodiments given below serve to explain and teach the principles described herein.

DETAILED DESCRIPTION

Figure 1:
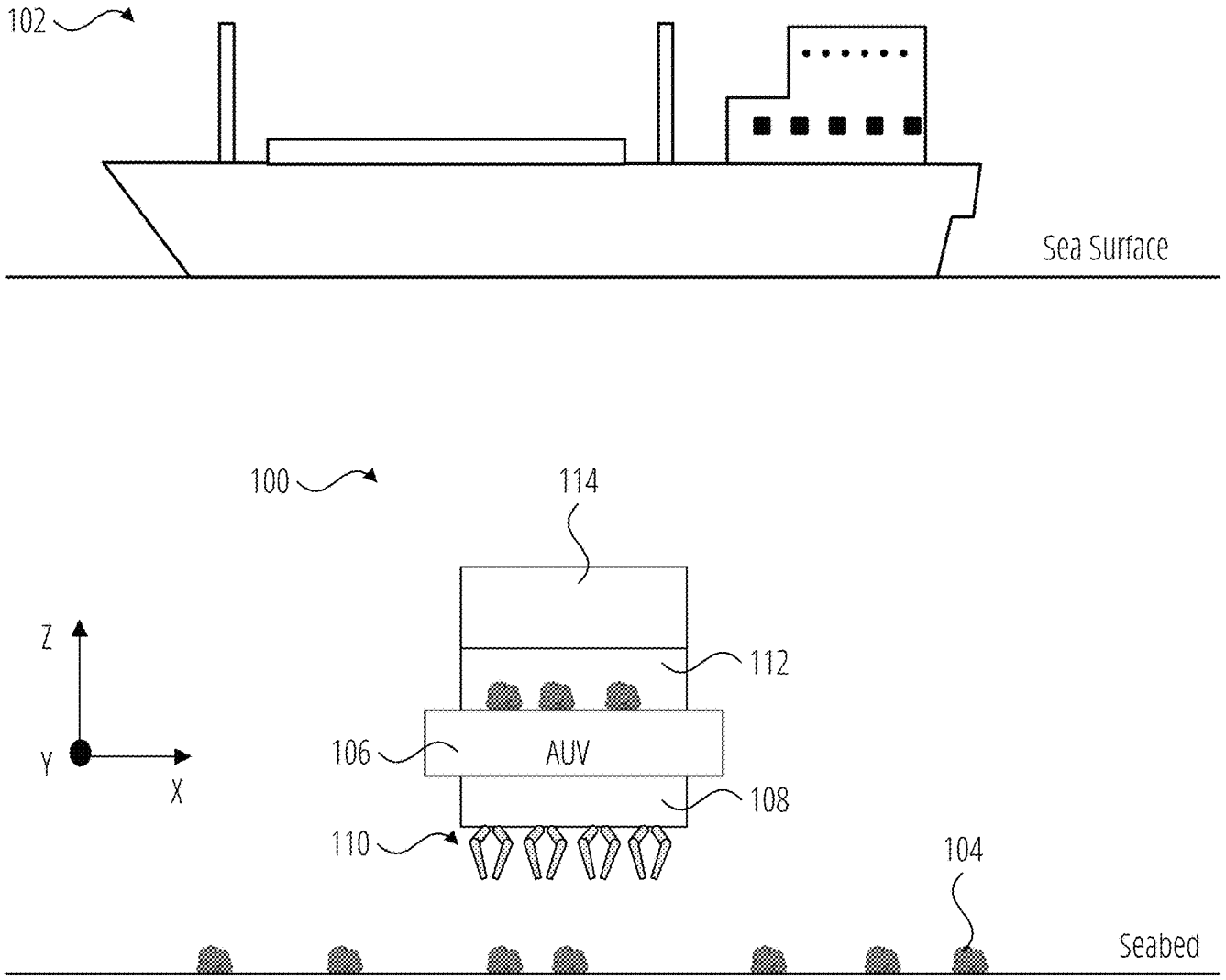
FIG. 1 illustrates an exemplary deep-sea mining system, in accordance with some embodiments.

FIG. 1 illustrates an exemplary deep-sea mining system 100 deployed from a mining ship 102 to collect ore nodules 104 disposed on the seabed, according to some embodiments. Deep-sea mining system 100 descends at the vicinity of the seabed and hovers over the seabed during the ore collection process. In some embodiments, deep-sea mining system 100 includes an autonomous underwater vehicle (AUV) 106, an ore collector system 108 for collecting ore nodules 104 form the seabed, a payload hopper 112 for temporarily storing the collected ore nodules 104, and a dynamic buoyancy system 114 for enabling the deep-sea mining system 100 to maneuver primarily in a vertical direction z (e.g., to descend from the sea surface to the seabed and ascend from the seabed to the sea surface).

According to some embodiments, AUV 106 is equipped with thrusters (not shown in FIG. 1) that enable deep-sea mining system 100 to maneuver primarily in a lateral direction (e.g., parallel to the seabed-along the x-y plane) and secondarily in the vertical direction (e.g., along the z-direction). By way of example and not limitation, ore collector system 108 can be equipped with robotic arms 110 that may extend towards the seabed and reach for the ore nodules 104. In some embodiments, the robotic arms 110 can harvest the ore nodules 104 by picking them up as the deep-sea mining system 100 hovers over the seabed using suitable end effectors not shown in FIG. 1. Once picked up, the ore nodules 104 can be disposed into payload hopper 112.

According to some embodiments, deep-sea mining system 100 uses underwater surveying and inspection systems to locate the ore nodules 104 on the seabed and to determine whether marine life is anchored on the ore nodules 104. By way of example and not limitation, deep-sea mining system 100 may be configured to avoid collecting ore nodules 104 having marine life anchored on them. Once the payload hopper 112 is full, the dynamic buoyancy system 114 enables the deep-sea mining system 100 to ascend to the sea surface and deliver its payload (e.g., the collected ore nodules 104). In some embodiments, the dynamic buoyancy system 114 is configured to keep the deep-sea mining system 100 neutrally buoyant at any depth, and in particular close to the operating depth, while limiting the use of electrically powered thrusters to conserve energy.

According to some embodiments, the components of deep-sea mining system 100 (e.g., dynamic buoyancy system 114, payload hopper 112, ore collector system 108, and AUV 106) operate in synergy. In some embodiments, these components may be either integrated in a single housing or operated as detachable modules physically and communicatively connected to one another. According to some embodiments, dynamic buoyancy system 114, payload hopper 112, ore collector system 108, and AUV 106 are physically attached to one another during the collection/mining process, and at least the payload hopper 112 and the dynamic buoyancy system 114 can be physically attached to one another during the mining and ascending process. In some embodiments, the dynamic buoyancy system 114 can provide the necessary buoyancy to compensate for the collected ore nodules 104 during the mining process and the ascent of at least the payload hopper 112 or of the entire deep-sea mining system 100. In some embodiments, if the dynamic buoyancy system 114 and the payload hopper 112 ascend on their own to the ocean surface, AUV 106 may provide with its thrusters the necessary buoyancy to deep-sea mining system 100 until the dynamic buoyancy system 114 and the payload hopper 112 descend again from the sea surface to re-attach to the deep-sea mining system 100.

In some embodiments, deep-sea mining system 100 can include additional components, modules, and systems necessary for its indented operation. These additional components, modules, and systems are not shown in FIG. 1 for simplicity and ease of illustration. By way of example and not limitation, these additional components, modules, and systems may include cables, one or more onboard computers, electronic equipment, sensors, additional thrusters, motors, batteries, communication equipment, cameras, radars, controllers, global positioning systems, and the like. These additional components, modules, and systems are within the spirit and the scope of this disclosure. In some embodiments, deep-sea mining system 100 may operate under autonomous mode, semi-automatic mode, manual mode, or combinations thereof based on instructions from mining ship 102. In yet another embodiment, deep-sea mining system 100 may be communicatively coupled and physically connected to mining ship 102 via cables or other suitable means. To deploy and recover deep-sea mining systems, like the deep-sea mining system 100 shown in FIG. 1, mining ship 102 is equipped with a launch and recovery system referred to henceforth as a LAR system.

In the description that follows with regards to the LAR system, the term AUV is intended to describe a deep-sea mining system. Accordingly, any reference to an AUV or AUV 106 is indented to mean or describe a deep-sea mining system, such as the deep-sea mining system 100 described in FIG. 1.

Figure 2:
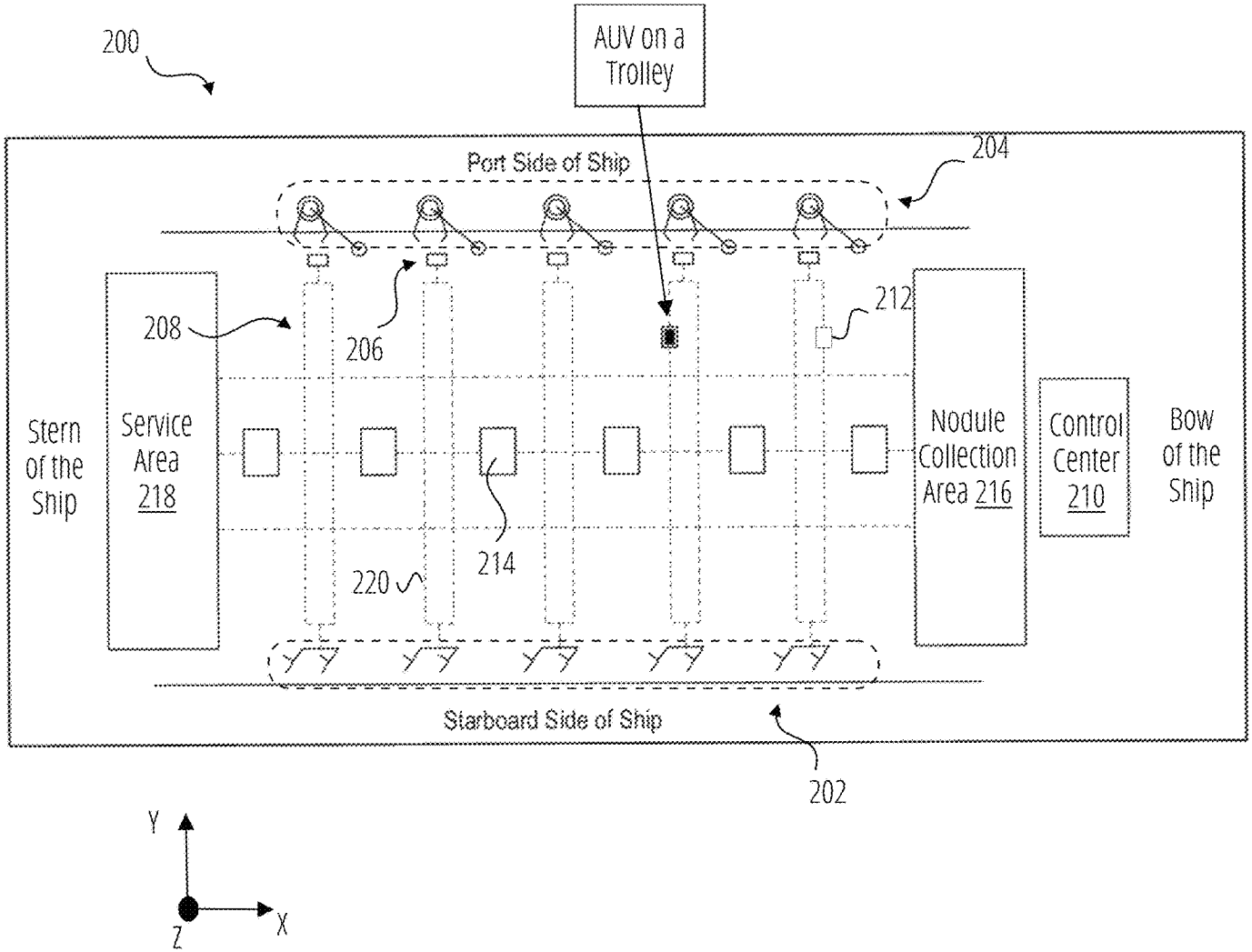
FIG. 2 illustrates a launch and recovery (LAR) system deployed on a deck of a mining ship, in accordance with some embodiments.

According to some embodiments, FIG. 2 illustrates a LAR system 200 installed on the deck of a ship or vessel, such as the mining ship 102 in FIG. 1. By way of example and not limitation, the LAR system 200 may be disposed lengthwise the mining ship 102 (e.g., between the ship's bow and stern) and may occupy a portion or the entire width of the mining ship 102. According to some embodiments, the LAR system 200 can streamline the processes of deploying the AUVs into the water, recovering the AUVs form the water, emptying the AUVs from their payload, charging the AUVs, and repairing the AUVs. For example, the LAR system 200 can empty the AUVs of their ore nodule load, transport the AUVs for maintenance, transport them for recharging, transport them for other on-deck operations, or redeploy them back to the water.

In some embodiments, the LAR system 200 can perform the aforementioned operations autonomously, with limited or no human intervention. For this reason, the LAR system 200 includes multiple sub-systems configured to perform different operations. As an example, the LAR system 200 in FIG. 2 includes five main sub-systems: a launch system 202, a recovery system 204, a recovery pad and trolley system 206, and a rail system 208. A control center 210 supervises the operations of each sub-system and evaluates the health of the entire LAR system 200. These sub-systems and their operation are described below.

Launch System

Figure 3:
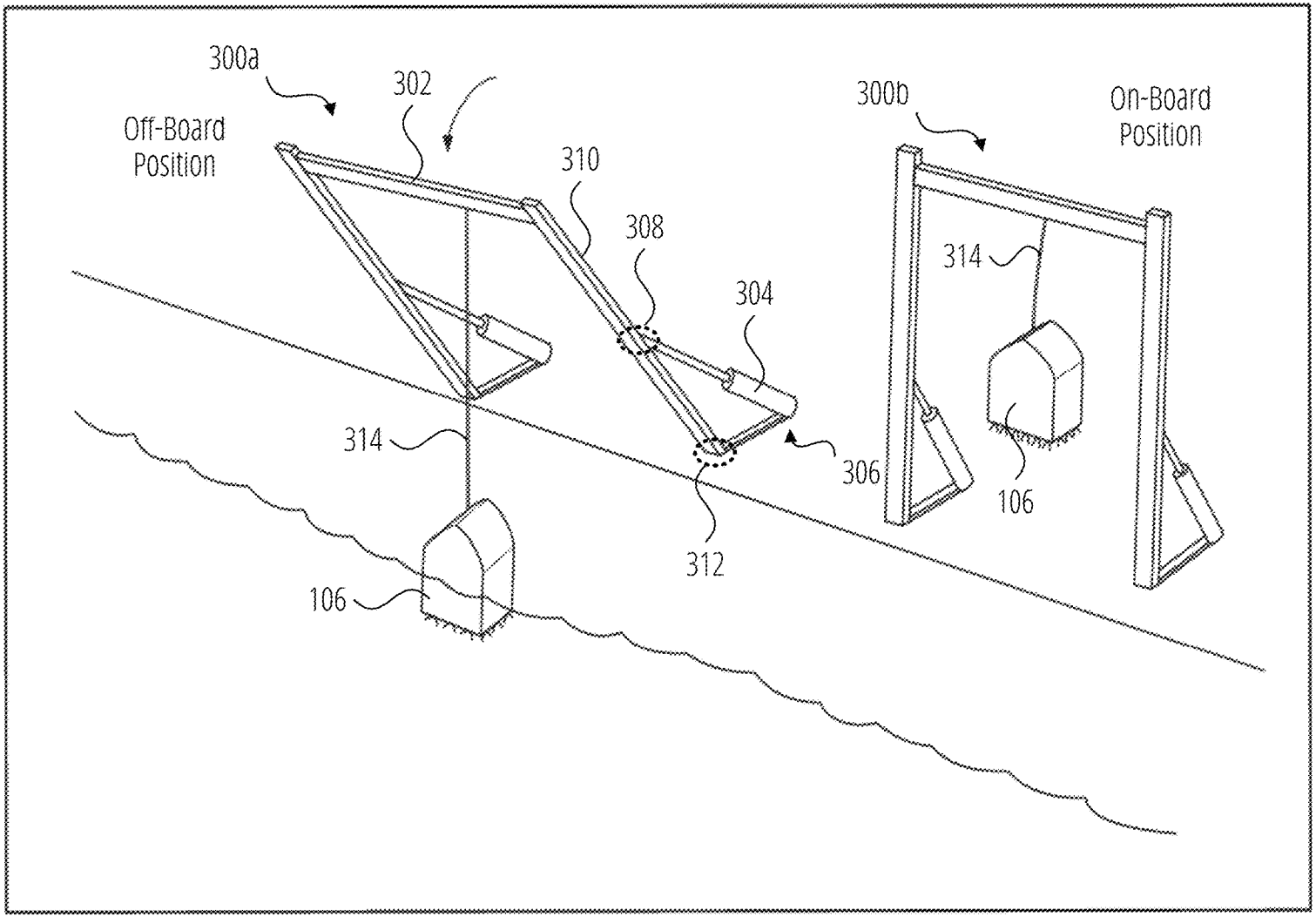
FIG. 3 illustrates components of a launch system for autonomous underwater vehicles (AUVs), in accordance with some embodiments.

According to some embodiments, the launch system 202 can include one or more cranes for launching (e.g., lowering or deploying) the AUVs into the sea from a side of the mining ship 102, such as the starboard side of the mining ship 102 (as shown in FIG. 2) or, alternatively, the port side of the ship. FIG. 3 depicts exemplary cranes 300*a* and 300*b* used by the launch system 202 for deploying AUVs from the deck of mining ship 102 back to the sea. In some implementations, the cranes 300*a* and 300*b* can be A-frame type cranes featuring a pair of hydraulic pistons 304. However, this is not limiting, and the launch system 202 can include other types of cranes including, but no limited to, knuckle boom cranes, offshore cranes, other suitable types of cranes, or any combinations thereof. These other types of cranes and their combinations are within the spirit and the scope of this disclosure. For example purposes, cranes 300*a* and 300*b* will be described in the context of A-frame type cranes. The hydraulic pistons 304 can have a first end 306 securely anchored to the deck of the mining ship 102 while a second end 308 can be anchored to a side beam 310 of the crane so that cranes 300*a* and crane 300*b* can pivot around pivot points 312 in a forward motion as the hydraulic pistons 304 extend, and in an backward motion as the hydraulic pistons 304 retract from their extended position. The horizontal beam 302 of the cranes 300*a* and 300*b* can be securely attached to a top portion of the AUV 106 via a remotely activated latch mechanism and cable system while the hydraulic pistons 304 are operated.

The AUV 106 can be positioned at a "pick-up" location with the crane into its on-board position (e.g., in an upright position). Subsequently, the AUV 106 can be lifted slightly with a winch cable 314 so that it is clear of the deck while the on-deck components for the crane (e.g., the hydraulic pistons 304) pivot the crane towards its off-board position. When the crane is at its off-board position, the AUV 106 can be lowered into the sea level and released with the help of a release mechanism attached to the top of the AUV 106 between the AUV 106 and the end of the winch cable 314.

As shown in FIG. 3, crane 300*b* is in an upright (on-board) position while crane 300*a* is in a tilted (off-board) position so that the AUV 106 can be lowered into the water. According to some embodiments, and as the crane 300*a* pivots towards the water, the AUV 106 hovers over the water surface and is positioned off-board of the vessel by the crane's pivoting motion. The AUV 106 is gradually lowered into the water by the crane's winch system which extends the winch cable 314 of the launch system. Once released, the AUV 106 may begin its descent to the seabed to collect ore nodules 104. According to some embodiments, the launch system 202 may include multiple cranes along the side of the mining ship 102 (e.g., 2, 4, 6, 8, 10, etc.) as shown in FIG. 2.

In some implementations, cranes 300*a* and 300*b*, are operated from the control center 210. For example, control center 210 may use signals from onsite sensors, detectors, and other electronic equipment to control the movement of the cranes 300*a* and 300*b* in launch system 202. For example, the control center 210 may be equipped with electronic controllers, such as computers running suitable software or computer-implemented models that may automatically operate cranes 300*a* and 300*b* based on feedback received from other sub-systems within the LAR system 200. In further examples, the control center 210 may use appropriate logic, software, and computer-models (e.g., machine learning models, artificial intelligence models, and/or other computer-implemented models) to coordinate and optimize the operation of the cranes in launch system 202.

Recovery System

Figure 4:
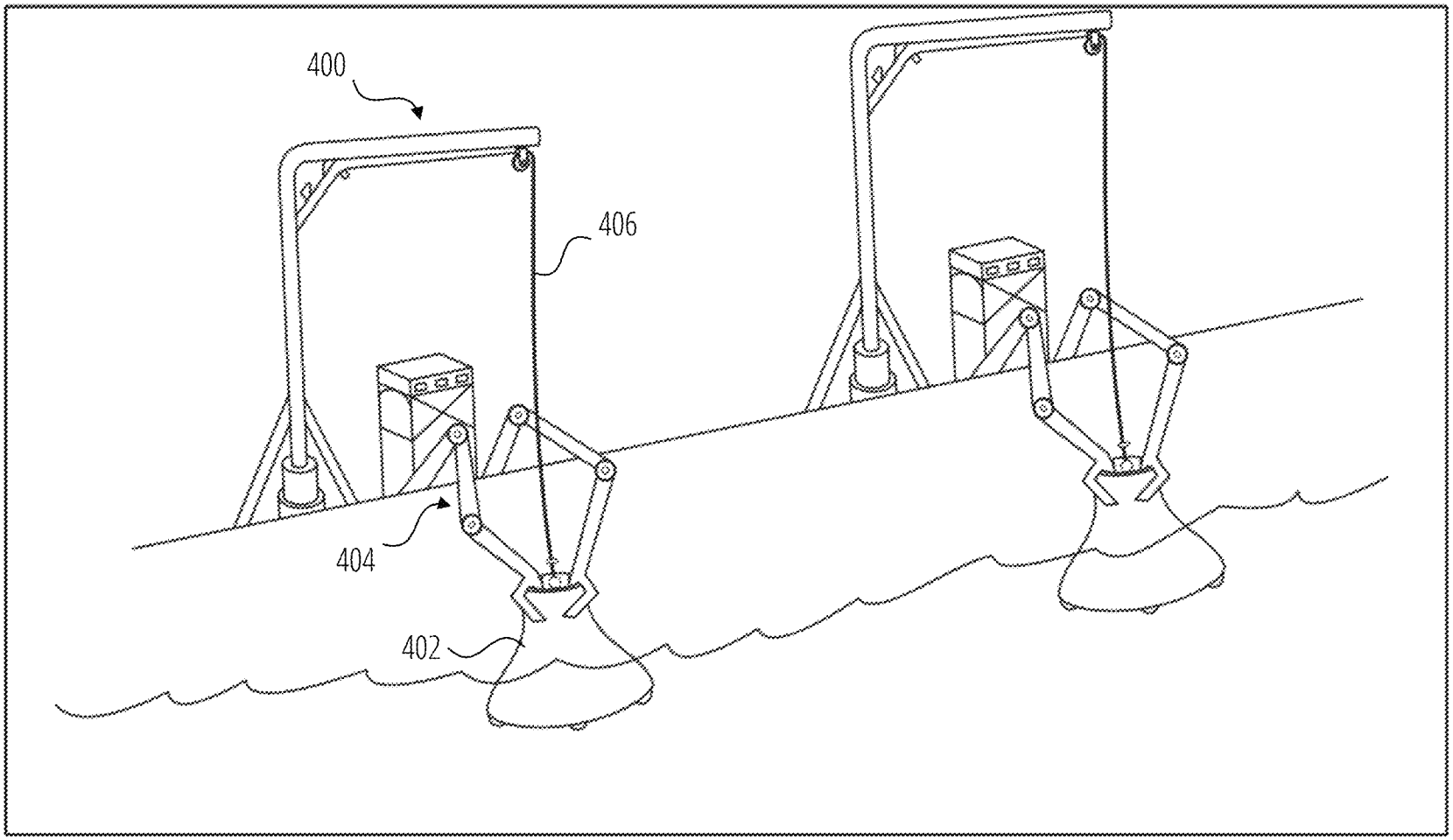
FIG. 4 illustrates components of a recovery system for autonomous underwater vehicles (AUVs), in accordance with some embodiments.

According to some embodiments, FIG. 4 illustrates individual components of the recovery system 204. Recovery system 204 may be positioned on a side of the mining ship 102 that is opposite to the side where the launch system 202 resides—e.g., on the port side of the mining ship 102 when the launch system 202 resides on the starboard side of the mining ship 102, as shown in FIG. 2. Once an AUV 106 returns to the water surface from its dive, it can be recovered by the recovery system 204.

In some implementations, the recovery system 204 can include one or more weight-bearing lifting cranes 400 and one or more funnels 402, with each funnel 402 being secured by one or more stabilizing arms 404. By way of example and not limitation, the stabilizing arms 404 can be a set of robotic electric arms designed to move so that the position of the funnel 402 can be controlled in six degrees of freedom during the recovery process. More specifically, the stabilizing arms 404 can be configured to maintain the funnel 402 stationary in a global coordinate frame despite the movement of the mining ship 102 and the sea surface, according to some embodiments. As shown in FIG. 4, the stabilizing arms 404 can be attached along the edge of the deck of the mining ship 102 so that they can position the funnel 402 such that at least a bottom edge of the funnel 402 remains submerged during the capture process.

According to some embodiments, the purpose of the funnel 402 is to capture the AUV 106 as the AUV 106 ascends from the seabed towards the sea surface. For this reason, the funnel 402 is shaped like a bell with a large bottom opening and narrower top portion to ensure a self-alignment process. In other embodiments, funnel 402 can be shaped like a pyramid whose number of sides varies depending on the weather conditions and/or other operating conditions, such as the movement of the ship at sea level. The funnel 402 can be made from a wire frame mesh to eliminate water drag and the formation of air pockets within its volume when submerged. In some implementations, the bottom edge of the funnel 402 is equipped with a combination of acoustic, optical, and magnetic sensors that may communicate with receivers located in the stabilizing arms 404 and/or the AUV 106. In some implementations, these sensors can provide critical information about the relative position (e.g., distances and angles) between the funnel 402 and AUV 106, so that appropriate adjustments can be made by the AUV thrusters until the AUVs 106 is securely captured by the funnel 402. For instance, as the AUV 106 approaches the large opening of the funnel 402, which can be submerged during the capturing process to a predetermined depth as shown in FIG. 4, the AUV 106 can be guided by the funnel sensors until the AUV 106 is secured in position (e.g., locked in position) inside the funnel 402. According to some embodiments, the depth at which the funnel 402 is submerged depends on the current operating conditions at sea. For example, the funnel 402 can be submerged to a depth at which the AUV 106 can adequately adjust its position regardless of the wave motion. In some embodiments, the funnel sensors may communicate with AUV sensors and the AUV's onboard computer to guide the AUV into position inside the funnel 402. In some embodiments, signals from the AUV sensors and the funnel sensors may be used by the control center 210 to determine the position of the AUV relative to the funnel. In some embodiments, signals from the AUV sensors and the funnel sensors may be used by the AUV's onboard computers to guide the AUV into position inside the funnel 402. All the above and other possible combinations are within the spirit and the scope of this disclosure.

Figure 5B:
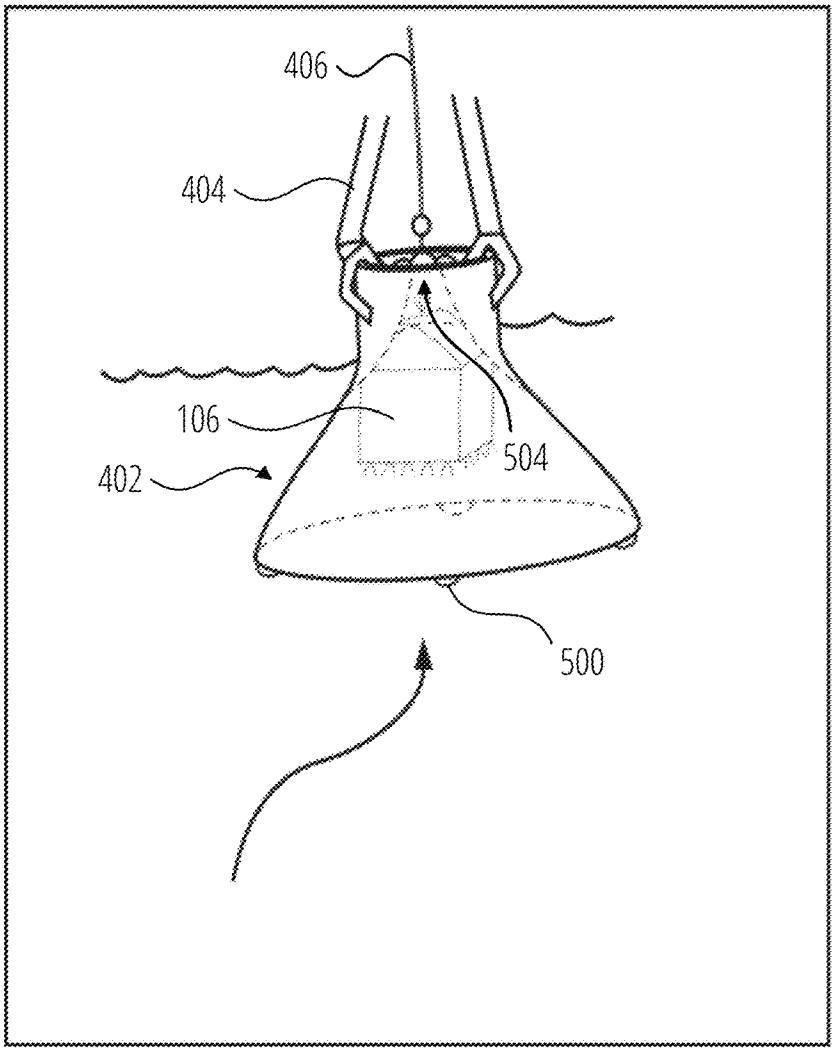
FIG. 5B illustrates another aspect of a recovery process for an autonomous underwater vehicle (AUV), in accordance with some embodiments.
Figure 5A:
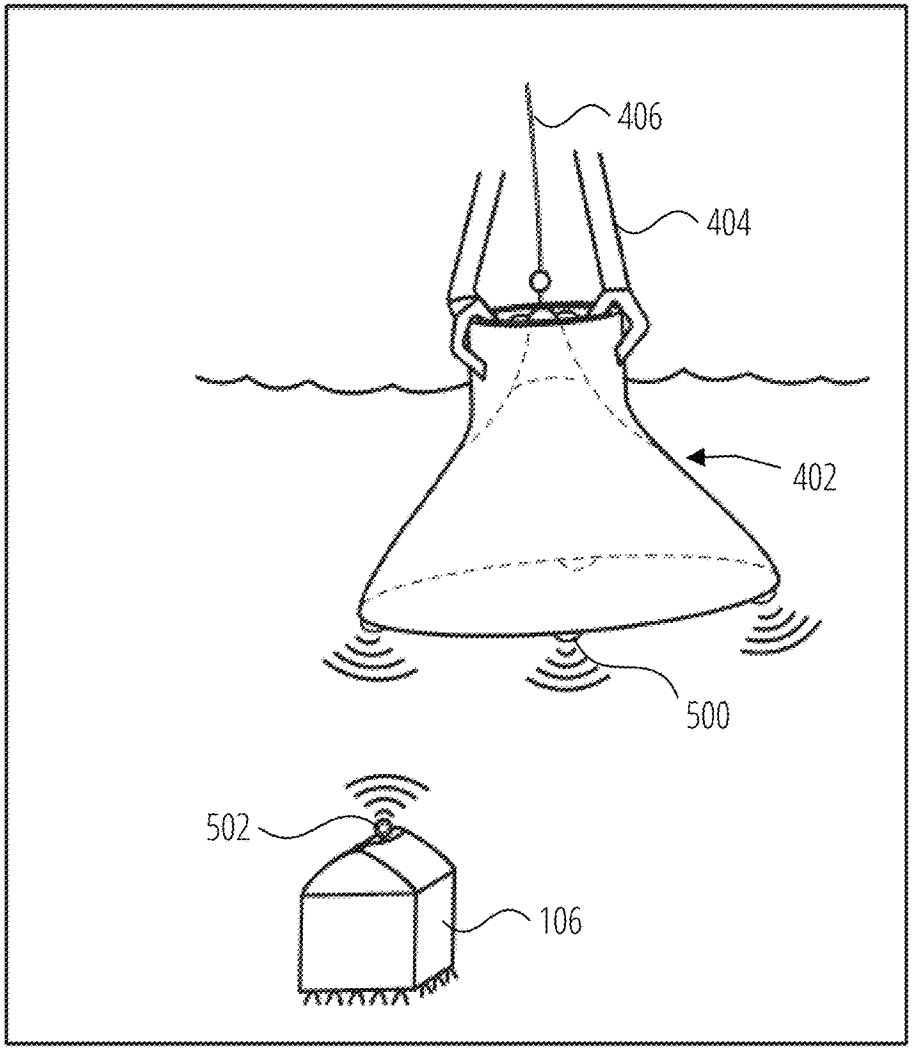
FIG. 5A illustrates an aspect of a recovery process for an autonomous underwater vehicle (AUV), in accordance with some embodiments.

According to some embodiments, FIG. 5A and FIG. 5B illustrate the recovery process of an AUV 106 by funnel 402. As shown in FIG. 5A, the funnel sensors 500 and the AUV sensors 502 can provide continuous signals with regards to the position of the AUV 106 relative to the funnel 402. That is, AUV sensors 502 and funnel sensors 500 may provide relative distance and angle information to the stabilizing arms 404 and the dynamic buoyancy system 114 and/or thrusters of the AUV 106, so that the position of AUV 106 is continuously monitored and adjusted with respect to funnel 402. During the capturing process, the funnel 402 is kept stationary despite the movement of the mining ship 102 and the water, as discussed above. Once the AUV 106 is positioned inside the funnel 402, as shown in FIG. 5B, a locking mechanism 504 inside the funnel 402 is activated to secure the AUV 106 prior to having the AUV 106 lifted by the weight-bearing lifting crane 400. In some examples, the locking mechanism 504 can include robotically actuated pins that are inserted into a receptacle on the AUV 106 to restrict the motion of the AUV 106 relative to the funnel 402. In some embodiments, the locking mechanisms 504 restricts the vertical, lateral, and angular motion of AUV 106 relative to funnel 402.

According to some embodiments, the weight-bearing lifting crane 400 can be a cable-based hydraulic lifting crane operable to lift the funnel 402 and AUV 106 onto a recovery pad on the deck of mining ship 102. In some implementations, the weight-bearing lifting crane 400 may be configured to swing in a lateral direction around a vertical axis so that the funnel 402 and the AUV 106 can be lifted and placed on a recovery pad. A cable 406 from the weight-bearing lifting crane 400 can be attached to an appropriate receptor on the upper most portion of the funnel 402 during the recovery operation. In some implementations, no tension is applied to the cable 406 during the capture operation. This ensures that the cable 406 does not exert any force on the stabilizing arms 404 and does not interfere with their operation while the AUV 106 is captured. Once the AUV 106 is secured, the weight-bearing lifting crane 400 can lift the AUV 106 and funnel 402 out of the water with guidance from the stabilizing arms 404 and place the AUV 106 on a recovery pad.

In one embodiment, the operations of the weight-bearing lifting crane 400 and the stabilizing arms 404 can be supervised by the control center 210. In another embodiment, the operations of the funnel sensors 500 and/or the AUV sensors 502 can be supervised by the control center 210. In yet another embodiment, the operation of the recovery system 204, including all of its components, can be supervised by the control center 210. In yet another embodiment, the operation of the recovery system 204, including all of its components, and the operation of the AUV 106 when approaching the mining ship 102 can be supervised by the control center 210.

Recovery Pad and Trolley

Figure 6:
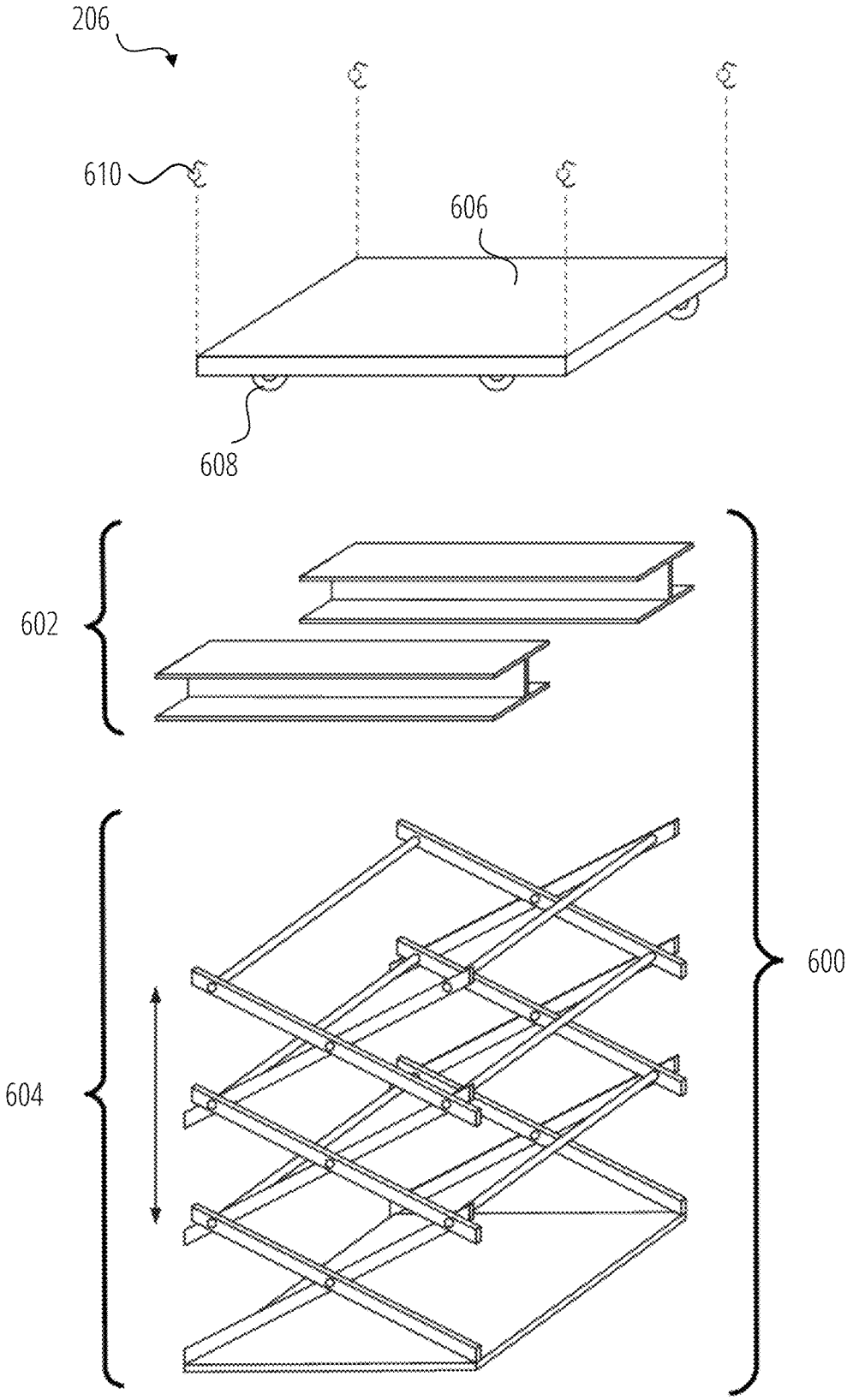
FIG. 6 illustrates components of recovery pad and trolley system, in accordance with some embodiments.

According to some embodiments, FIG. 6 illustrates a vertically expanded view of the components in the recovery pad and trolley system 206. According to FIG. 6, the recovery pad and trolley system 206 can include at least a recovery pad 600 and a trolley 606. The recovery pad 600 can further include a rail section 602 supported by a hydraulic scissor lift 604. According to some embodiments, the hydraulic scissor lift 604 can move the rail section 602 in a vertical motion (e.g., upwards or downwards) as indicated by the two-directional arrow. Trolley 606 can be equipped with wheels 608 which allow the trolley 606 to ride on the rail section 602 of the recovery pad 600 and on the rail system 208 shown in FIG. 2. According to some embodiments, the track width of the rail section 602 of the recovery pad 600 matches the track width of the rail system 208. However, contrary to the rails of the rail system 208, which are stationery, the rail section 602 of the recovery pad 600 can be raised vertically via the hydraulic scissor lift 604 so that the trolley 606 can receive the AUV 106, as discussed below.

Figure 7:
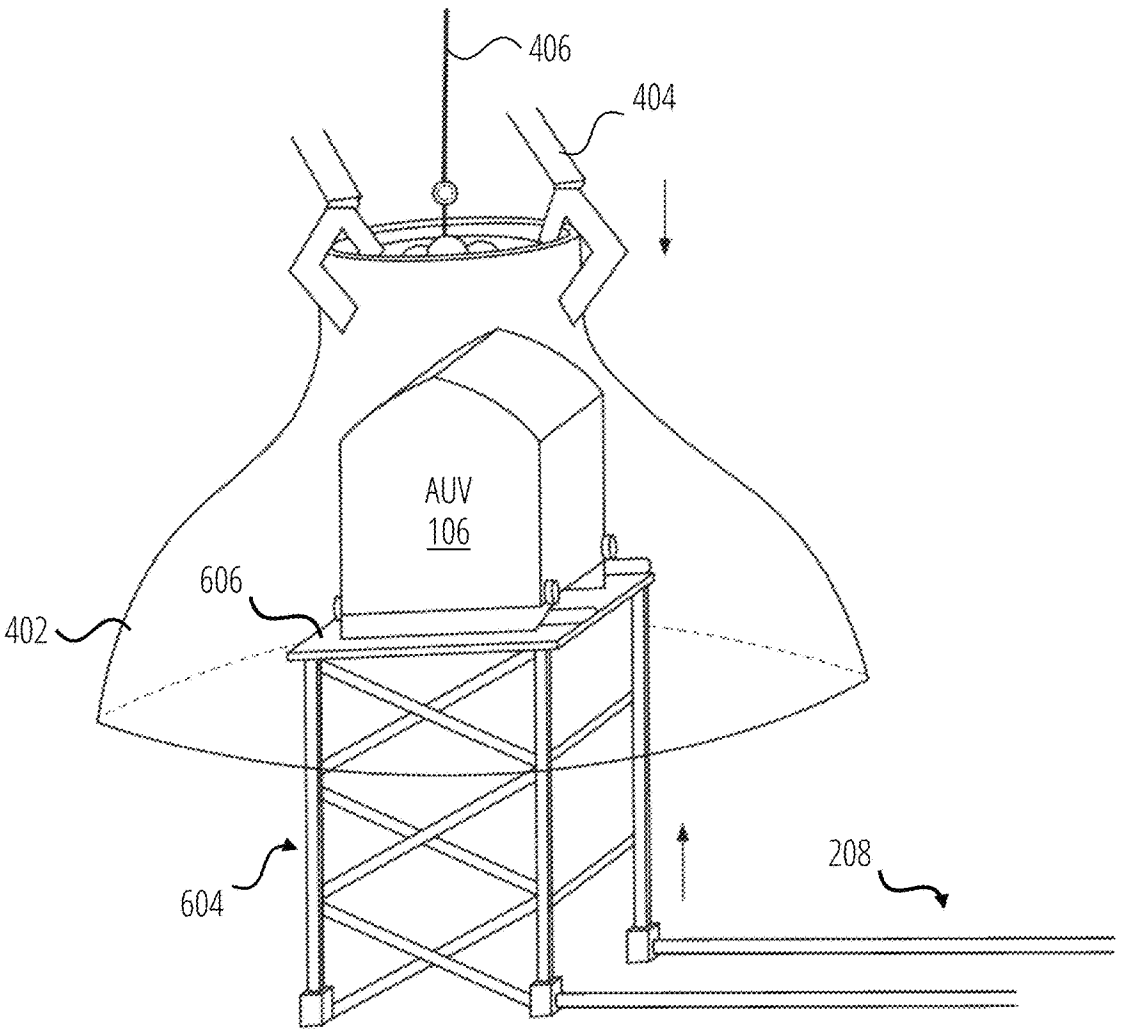
FIG. 7 illustrates a receiving process for an autonomous underwater vehicle (AUV) by a recovery pad and trolley system, in accordance with some embodiments.

According to some embodiments, FIG. 7 illustrates the receiving process for an AUV 106 by the recovery pad and trolley system 206. More specifically, once the AUV 106 is secured in the funnel 402, the weight-bearing lifting crane 400, with assistance from the stabilizing arms 404, lifts the funnel 402 out of the water and over the recovery pad 600, which can be at its lowest vertical position setting. Subsequently, the hydraulic scissor lift 604 can extend upwards to raise and position the recovery pad 600 inside the base of the funnel 402, as shown in FIG. 7. In some embodiments, the funnel 402 can be self-aligned to the recovery pad 600 via an appropriate mechanism so that the AUV 106 may rest on a designated area of the trolley 606. The base of the AUV 106 can be then secured on a top surface of the trolley 606 via AUV locks 610 shown in FIG. 6. Once the AUV 106 is secured on the trolley 606, the funnel 402 can release the AUV 106 so that the weight-bearing lifting crane 400, the stabilizing arms 404, and the funnel 402 can move upwards and away from the recovery pad and trolley system 206. For example, the weight-bearing lifting crane 400 and the stabilizing arms 404 may return the funnel 402 to the water so that the funnel 402 can collect the next AUV 106.

According to some embodiments, and in referring to FIG. 2, LAR system 200 can include shipping containers, such as shipping containers 212, which can be configured to ride on the rail system 208 to collect payloads with ore nodules 104 from the recovered AUVs 106. For example, while the recovered AUV 106 is elevated on the recovery pad 600, a shipping container 212 may approach the AUV 106 via the rail system 208 to collect the AUV's payload. In some embodiments, the shipping container 212 is positioned adjacent to the AUV 106 (e.g., along a side of the AUV) so that the shipping container 212 is at a lower height level than the payload hopper 112 of the AUV 106. The side of the AUV 106 proximal to the shipping container 212 can be configured to open (e.g., outwards like a hatch) so that the payload with ore nodules 104 can be transferred (e.g., by means of gravitational force) from the payload hopper 112 to the shipping container 212. In some embodiments, the side of the AUV 106 proximal to the shipping container 212 may be equipped with a hatch or other suitable release mechanism that enables the payload to be transferred from the payload hopper 112 to the shipping container 212. Once the payload of AUV 106 is transferred to the shipping container 212, the shipping container 212 may travel along the rail system 208 to unload the collected ore nodules 104 to a central nodule collection area 216.

In some embodiments, once the payload with ore nodules 104 is removed from the AUV 106, the AUV 106 can be lowered by the hydraulic scissor lift 604 towards the rail system 208. According to some embodiments, the hydraulic scissor lift 604 can lower the recovery pad 600 such that the rail section 602 of the recovery pad 600 is self-aligned to the rails of the rail system 208. Once the rail section 602 of the recovery pad 600 is aligned to the rails of the 208, the trolley 606 can move from the recovery pad 600 onto the rail system 208 and be directed towards a service area 218, a battery station 214, or to a launch site of the launch system 202. Once the AUV 106 has been offloaded to any of the service area 218, a battery station 214, or the launch system 202, the empty trolley 606 may return onto the recovery pad 600 in preparation for the next AUV 106 recovery operation.

As shown in FIG. 2, the rail system 208 can form an expanded network of rails 220 that allows trolleys 606 carrying AUVs 106 (indicated as solid box in FIG. 2) and shipping containers 212 (indicated as a white box in FIG. 2) to travel between various locations along the deck of the mining ship 102. Consequently, the network of rails 220 can connect various sections and areas of the LAR system 200 on the deck of mining ship 102. According to some embodiments, the rail system 208 can be a series of tracks in a grid pattern as shown in FIG. 2. However, this is not limiting, and the network of rails 220 may have any suitable pattern. The tracks of the rail systems 208, including the rail section 602 of recovery pad 600, constrain the movement of the trolley 606 in five degrees of freedom (e.g., allow movement along the x-, y-, and z-axes) so that the trolleys 606 can move as described herein.

According to some embodiments, the rail system 208 can be equipped with a third rail system that powers the trolleys 606. In some embodiments the trolleys 606 are powered by rechargeable batteries. In further embodiments, the network of rails 220 may provide redundancy pathways to ensure that technical difficulties will not halt the processes performed by LAR system 200, and that the launch system 202 and recovery system 204 stay connected with the battery stations 214, the nodule collection area 216, and the service area 218 at all times.

An AUV 106, once recovered from the sea, can be placed on a trolley 606 at a recovery pad location and emptied from its payload. From there, the trolley 606 can be transferred onto the rail system 208 and be directed, for example, to a battery station 214 to charge or get the battery pack of the AUV replaced. Once the AUV's batteries are sufficiently charged or replaced, the AUV 106 may continue to one or many launch sites of the launch system 202 where the AUV 106 can be removed from the rail system 208 to be deployed back to the water. In some embodiments, damaged AUVs 106 can travel via the rail system 208 to the service area 218 for repairs. In some embodiments, shipping containers 212 may travel between the recovery pads 600 and the nodule collection area 216 to collect and offload nodule loads from the recovered AUVs 106.

Control Center

According to some embodiments, the control center 210 can be an operational center that supervises the autonomous operations of LAR system 200 described herein. In some embodiments, the control center 210 may monitor the autonomous operations of LAR system 200 with a monitor system that may, for example, include a closed video circuit; sensors distributed throughout the LAR system 200; and or direct views to the recovery system 204, the launch system 202, the rail system 208, the service area 218, the battery stations 214, and the nodule collection area 216. In some embodiments, the control center 210 has suitable infrastructure (e.g., it is equipped with appropriate software and hardware) to enable the LAR systems 200 to operate autonomously. In some implementations, the control center 210 is a command center that may pause and re-initiate operations within the LAR system 200. Further, the control center 210 ensures that the LAR system 200 is operating at an optimal rate.

ADDITIONAL CONSIDERATIONS

The phraseology and terminology used herein is for the purpose of description and should not be regarded as limiting.

Although the concepts and principles of operation for the launch system 202, the recovery system 204, the recovery pad and trolley system 206, the rail system 208, and the control center 210 of the LAR system 200 have been described with limited number of components for simplicity, these systems may include additional suitable electronic and/or mechanical components. Such components may include, but are not limited to, computers, power supplies, electrical control panels, etc. These additional components are within the spirit and the scope of this disclosure.

Furthermore, connections between components or systems within the figures are not intended to be limited to direct connections. Rather, data or signals between these components may be modified, re-formatted, or otherwise changed by intermediary components. Also, additional or fewer connections may be used. The terms "coupled," "connected," or "communicatively coupled" shall be understood to include direct connections, indirect connections through one or more intermediary devices, wireless connections, and so forth.

Additionally, the launch system 202, the recovery system 204, the recovery pad and trolley system 206, and the rail system 208, as described herein are modular, which means that one or more systems may be added together as necessary depending on the number of AUVs and the size of the mining ship 102. Further, permutations, combinations, and modification that may result in simpler or more efficient versions of the systems disclosed herein are within the spirit and the scope of this disclosure.

Reference in the specification to "one embodiment," "preferred embodiment," "an embodiment," "some embodiments," or "embodiments" means that a particular feature, structure, characteristic, or function described in connection with the embodiment is included in at least one embodiment of the invention and may be in more than one embodiment. Also, the appearance of the above-noted phrases in various places in the specification is not necessarily referring to the same embodiment or embodiments.

The use of certain terms in various places in the specification is for illustration purposes only and should not be construed as limiting. A service, function, or resource is not limited to a single service, function, or resource; usage of these terms may refer to a grouping of related services, functions, or resources, which may be distributed or aggregated.

Furthermore, one skilled in the art shall recognize that: (1) certain steps may optionally be performed; (2) steps may not be limited to the specific order set forth herein; (3) certain steps may be performed in different orders; and (4) certain steps may be performed simultaneously or concurrently.

The term "approximately", the phrase "approximately equal to", and other similar phrases, as used in the specification and the claims (e.g., "X has a value of approximately Y" or "X is approximately equal to Y"), should be understood to mean that one value (X) is within a predetermined range of another value (Y). The predetermined range may be plus or minus 20%, 10%, 5%, 3%, 1%, 0.1%, or less than 0.1%, unless otherwise indicated.

The indefinite articles "a" and "an," as used in the specification and in the claims, unless clearly indicated to the contrary, should be understood to mean "at least one." The phrase "and/or," as used in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of or "exactly one of," or, when used in the claims, "consisting of," will refer to the inclusion of exactly one element of a number or list of elements. In general, the term "or" as used shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

The use of "including," "comprising," "having," "containing," "involving," and variations thereof, is meant to encompass the items listed thereafter and additional items.

Use of ordinal terms such as "first," "second," "third," etc., in the claims to modify a claim element does not by itself connote any priority, precedence, or order of one claim element over another or the temporal order in which acts of a method are performed. Ordinal terms are used merely as labels to distinguish one claim element having a certain name from another element having a same name (but for use of the ordinal term), to distinguish the claim elements.

Implementations of the subject matter and the operations described in this specification can be implemented in digital electronic circuitry, or in computer software, firmware, or hardware, including the structures disclosed in this specification and their structural equivalents, or in combinations of one or more of them. Implementations of the subject matter described in this specification can be implemented as one or more computer programs, i.e., one or more modules of computer program instructions, encoded on computer storage medium for execution by, or to control the operation of, data processing apparatus. Alternatively or in addition, the program instructions can be encoded on an artificially generated propagated signal, e.g., a machine-generated electrical, optical, or electromagnetic signal, that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate physical components or media (e.g., multiple CDs, disks, or other storage devices).

The operations described in this specification can be implemented as operations performed by a data processing apparatus on data stored on one or more computer-readable storage devices or received from other sources.

The term "data processing apparatus" encompasses all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic disks, magneto-optical disks, optical disks, or solid state drives. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few. Devices suitable for storing computer program instructions and data include all forms of non-volatile memory, media and memory devices, including, by way of example, semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented on a computer having a display device, e.g., a CRT (cathode ray tube) or LCD (liquid crystal display) monitor, for displaying information to the user and a keyboard and a pointing device, e.g., a mouse, a trackball, a touchpad, or a stylus, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some implementations, a server transmits data (e.g., an HTML page) to a client device (e.g., for purposes of displaying data to and receiving user input from a user interacting with the client device). Data generated at the client device (e.g., a result of the user interaction) can be received from the client device at the server.

In some embodiments, aspects of the systems and methods described herein may be implemented using ML and/or AI technologies.

"Machine learning" generally refers to the application of certain techniques (e.g., pattern recognition and/or statistical inference techniques) by computer systems to perform specific tasks. Machine learning techniques may be used to build models based on sample data (e.g., "training data") and to validate the models using validation data (e.g., "testing data"). The sample and validation data may be organized as sets of records (e.g., "observations" or "data samples"), with each record indicating values of specified data fields (e.g., "independent variables," "inputs," "features," or "predictors") and corresponding values of other data fields (e.g., "dependent variables," "outputs," or "targets"). Machine learning techniques may be used to train models to infer the values of the outputs based on the values of the inputs. When presented with other data (e.g., "inference data") similar to or related to the sample data, such models may accurately infer the unknown values of the targets of the inference data set.

As used herein, "model" may refer to any suitable model artifact generated by the process of using a machine learning algorithm to fit a model to a specific training data set. The terms "model," "data analytics model," "machine learning model" and "machine learned model" are used interchangeably herein.

As used herein, the "development" of a machine learning model may refer to construction of the machine learning model. Machine learning models may be constructed by computers using training data sets. Thus, "development" of a machine learning model may include the training of the machine learning model using a training data set. In some cases (generally referred to as "supervised learning"), a training data set used to train a machine learning model can include known outcomes (e.g., labels or target values) for individual data samples in the training data set. For example, when training a supervised computer vision model to detect images of cats, a target value for a data sample in the training data set may indicate whether or not the data sample includes an image of a cat. In other cases (generally referred to as "unsupervised learning"), a training data set does not include known outcomes for individual data samples in the training data set.

Following development, a machine learning model may be used to generate inferences with respect to "inference" data sets. For example, following development, a computer vision model may be configured to distinguish data samples including images of cats from data samples that do not include images of cats. As used herein, the "deployment" of a machine learning model may refer to the use of a developed machine learning model to generate inferences about data other than the training data.

"Artificial intelligence" (AI) generally encompasses any technology that demonstrates intelligence. Applications (e.g., machine-executed software) that demonstrate intelligence may be referred to herein as "artificial intelligence applications," "AI applications," or "intelligent agents." An intelligent agent may demonstrate intelligence, for example, by perceiving its environment, learning, and/or solving problems (e.g., taking actions or making decisions that increase the likelihood of achieving a defined goal). In many cases, intelligent agents are developed by organizations and deployed on network-connected computer systems so users within the organization can access them. Intelligent agents are used to guide decision-making and/or to control systems in a wide variety of fields and industries, e.g., security; transportation; risk assessment and management; supply chain logistics; and energy management. Intelligent agents may include or use models.

Some non-limiting examples of AI application types may include inference applications, comparison applications, and optimizer applications. Inference applications may include any intelligent agents that generate inferences (e.g., predictions, forecasts, etc.) about the values of one or more output variables based on the values of one or more input variables. In some examples, an inference application may provide a recommendation based on a generated inference. For example, an inference application for a lending organization may infer the likelihood that a loan applicant will default on repayment of a loan for a requested amount, and may recommend whether to approve a loan for the requested amount based on that inference. Comparison applications may include any intelligent agents that compare two or more possible scenarios. Each scenario may correspond to a set of potential values of one or more input variables over a period of time. For each scenario, an intelligent agent may generate one or more inferences (e.g., with respect to the values of one or more output variables) and/or recommendations. For example, a comparison application for a lending organization may display the organization's predicted revenue over a period of time if the organization approves loan applications if and only if the predicted risk of default is less than 20% (scenario #1), less than 10% (scenario #2), or less than 5% (scenario #3). Optimizer applications may include any intelligent agents that infer the optimum values of one or more variables of interest based on the values of one or more input variables. For example, an optimizer application for a lending organization may indicate the maximum loan amount that the organization would approve for a particular customer.

Each numerical value presented herein, for example, in a table, a chart, or a graph, is contemplated to represent a minimum value or a maximum value in a range for a corresponding parameter. Accordingly, when added to the claims, the numerical value provides express support for claiming the range, which may lie above or below the numerical value, in accordance with the teachings herein. Absent inclusion in the claims, each numerical value presented herein is not to be considered limiting in any regard.

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In certain implementations, multitasking and parallel processing may be advantageous. Other steps or stages may be provided, or steps or stages may be eliminated, from the described processes. Accordingly, other implementations are within the scope of the following claims.

It will be appreciated by those skilled in the art that the preceding examples and embodiments are exemplary and not limiting to the scope of the present disclosure. It is intended that all permutations, enhancements, equivalents, combinations, and improvements thereto that are apparent to those skilled in the art upon a reading of the specification and a study of the drawings are included within the true spirit and scope of the present disclosure. It shall also be noted that elements of any claims may be arranged differently including having multiple dependencies, configurations, and combinations.

Having thus described several aspects of at least one embodiment of this invention, it is to be appreciated that various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A launch and recovery system comprises:

a launch system comprising a crane operable to lower an autonomous underwater vehicle (AUV) from a deck level of a ship to a sea level below the deck level;

a recovery system configured to collect the AUV from the sea level, the recovery system comprising a weight-bearing lifting crane, one or more stabilizing arms, and a funnel; and a rail system comprising a network of rails on which the AUV can travel once collected by the recovery system, wherein the one or more stabilizing arms are configured to keep the funnel stationary in a global coordinate frame while the funnel is at the sea level awaiting for the AUV to ascend.

2. The launch and recovery system of claim 1, further comprises a recovery pad and trolley system configured to receive the AUV from the recovery system and to transfer the AUV on the network of rails.

3. The launch and recovery system of claim 2, wherein the recovery pad and trolley system comprises a trolley on which the AUV is secured and a recovery pad.

4. The launch and recovery system of claim 3, wherein the recovery pad comprises a rail section configured to receive the trolley.

5. The launch and recovery system of claim 4, wherein a track width of the rail section of the recovery pad matches a track width of the rail system.

6. The launch and recovery system of claim 1, wherein the crane comprises an A-frame crane with at least one hydraulic piston that allows the A-frame crane to lean forward about a pivot point when the AUV is to be lowered to the sea level.

7. The launch and recovery system of claim 2, wherein the recovery pad and trolley system is configured to move in a vertical motion by a hydraulic scissor lift.

8. The launch and recovery system of claim 1, further comprising a service area, a nodule collection area, and battery stations.

9. The launch and recovery system of claim 8, wherein the rail system comprises a series of tracks in a grid pattern that connects a recovery pad and trolley system to the service area, the nodule collection area, the battery stations, and the launch system.

10. The launch and recovery system of claim 1, further comprising a control center configured to supervise operations of the launch system, the recovery system, and the rail system.

11. The launch and recovery system of claim 10, wherein the control center is further configured to enable an autonomous operation of the launch and recovery system.

12. The launch and recovery system of claim 1, wherein the funnel comprises sensors disposed on a bottom end of the funnel.

13. The launch and recovery system of claim 12, wherein the sensors comprise a combination of acoustic, optical, and magnetic sensors.

* * * * *